US006202393B1

(12) United States Patent
Myler et al.

(10) Patent No.: US 6,202,393 B1
(45) Date of Patent: Mar. 20, 2001

(54) BRIDLE BIT

(76) Inventors: Ronald James Myler, 2045 Good Hope Rd.; Robert Rex Myler, 1903 Good Hope Rd., both of Marshfield, MO (US) 65706; Dale Dee Myler, Rt. #1 Box 268, Buffalo, MO (US) 65622

( * ) Notice: Subject to any disclaimer, the term of this patent is extended or adjusted under 35 U.S.C. 154(b) by 0 days.

(21) Appl. No.: 09/361,017

(22) Filed: Jul. 23, 1999

(51) Int. Cl.[7] ..... B68B 1/06
(52) U.S. Cl. ..... 54/7
(58) Field of Search ..... 54/6.1, 7, 8

(56) References Cited

U.S. PATENT DOCUMENTS

| | | | | |
|---|---|---|---|---|
| 129,808 | * | 7/1872 | Fraser | 54/7 |
| D. 252,163 | | 6/1979 | Johnson | 54/7 X |
| D. 328,657 | | 8/1992 | Steele | D30/136 |
| 424,538 | * | 4/1890 | Cole | 54/7 |
| 682,125 | * | 9/1901 | Binkley | 54/6.1 |
| 3,628,308 | | 12/1971 | Lozier | 54/8 |
| 3,751,877 | | 8/1973 | Morgan | 54/8 X |
| 3,851,446 | | 12/1974 | Bischeltsrieder | 54/8 |
| 4,005,564 | | 2/1977 | Simington | 54/8 |
| 4,566,254 | | 1/1986 | Nagel | 54/8 |
| 4,587,797 | | 5/1986 | Conrad | 54/8 |
| 4,884,390 | | 12/1989 | Benjak et al. | 54/7 |
| 4,941,312 | | 7/1990 | Old, Sr. | 54/8 |
| 5,062,255 | | 11/1991 | Myler et al. | 54/7 |
| 5,231,818 | | 8/1993 | Newman | 54/71 |
| 5,357,735 | | 10/1994 | Fry | 54/9 |
| 5,528,884 | | 6/1996 | Johnson | 54/8 |
| 5,822,950 | | 10/1998 | de Moya et al. | 54/8 |

* cited by examiner

*Primary Examiner*—Robert P. Swiatek
(74) *Attorney, Agent, or Firm*—Klarquist Sparkman Campbell Leigh & Whinston, LLP

(57) ABSTRACT

A bridle bit including a mouthpiece connected to at least one cheek ring. The mouthpiece is sized and shaped to be received in a horse's mouth. The cheek ring, preferably generally ringed shaped, is connected to an end of the mouthpiece and resides closely adjacent to the cheek of the horse. The cheek ring includes a headstall slot extending radially through an upper circumferential portion of the ring so that each headstall slot is co-planar with a plane defined by a circumference of the ring. The cheek ring may also include a rein slot extending radially through a lower circumferential portion of the ring so that the rein slot is also co-planar with the plane defined by the circumference of the ring. Additionally, the cheek ring may include a curb chain aperture extending radially through the cheek ring. The curb chain aperture is preferably defined by the upper circumferential portion of the ring and preferably is disposed immediately adjacent to the headstall slot so that the curb chain aperture is co-planar with the plane defined by the circumference of the ring.

16 Claims, 3 Drawing Sheets

BRIDLE BIT

FIELD OF THE INVENTION

This invention relates generally to bridle bits, and more particularly to a streamlined bridle bit having a headstall slot that does not extend beyond a plane defined by a circumference of the bridle bit cheek ring.

BACKGROUND AND SUMMARY OF THE INVENTION

There are two main types of bridle bits: snaffle bits and curb bits. Snaffle bits allow a rider to control a horse by transmitting the pulling force of the reins to the horse's mouth. Curb bits, on the other hand, are known to allow riders more precise control over a horse through a leverage action provided, in part, by use of a curb chain placed under the horse's chin.

Although there are many different designs of snaffle bits, almost all include a mouthpiece with cheek rings (purchase rings) coupled to the outer ends thereof. The mouthpiece is typically a unitary piece or includes several pieces interconnected by one or more joints. A basic type of snaffle bit is the loose-ring snaffle bit that includes a mouthpiece and two cheek rings. The cheek rings of loose-ring bits are slidably fit through a bore at each end of the mouthpiece. The cheek rings may take various forms, such as a D-shape or an eggbut shape. Typically, a snaffle bit having D-shape or eggbut cheek rings includes a mouthpiece wherein each outer end terminates in a T-shaped joint. The T-shaped joint is adapted to receive the cheek ring.

Generally, a curb bit is simply a snaffle or solid mouth bit that has means to attach a curb chain or strap. A curb chain is typically looped around the cheek rings or it is coupled to an eye which is positioned at an upper end of a shank-type snaffle bit.

A bridle is typically connected to a conventional snaffle or curb bit by looping ends of both a headstall strap and a rein about the circumference of the cheek rings. The ends of the headstall strap and rein include fasteners for securing the strap or rein to the cheek ring.

A major drawback of using a conventional snaffle bit or curb bit is that there is considerable slippage of the headstall strap around the circumference of each cheek ring. The slippage causes misdirection of force vectors from the reins to the mouthpiece, sending ambiguous control signals to the horse. The same slippage problem occurs with the reins. In order to overcome such slippage, bridle bits may include hooks welded to each cheek ring that are adapted to receive a headstall strap and a rein. These hooks prevent the headstall strap and rein from sliding around the circumference of each ring, thereby providing superior control over the horse.

A conventional headstall strap hook (or rein hook) is welded to the cheek ring to extend in an inward direction (i.e., toward the horse), at an angle normal to a plane defined by the circumference of the ring (FIG. 1). When the hook extends inwardly toward the horse, the hook tends to pinch the horse's cheek, resulting in animal discomfort and possible injury or infection. There is also a potential danger to the rider or trainer because of an unexpected reaction of the horse to the pinching sensation caused by the hook.

Alternatively, axially extending headstall hooks have been welded to bridle bit cheek rings to extend in a direction away from the horse, at an angle normal to the planes defined by the rings. It is undesirable to use a bridle bit having visible hooks as many equestrians believe that such hooks are aesthetically unpleasing. In addition, a hook-type bridle bit is limited in use because many equestrian shows or competitions do not allow riders to use such bits.

The disadvantages of hook-type bridle bits are exacerbated when a curb chain is coupled to the bit. For example, headstall hooks do not have adequate space to simultaneously receive the end portion of a curb chain and a headstall strap. If the headstall strap and curb chain are squeezed into a single hook, the end portions of the curb chain are prevented from lying comfortably against a horse and tend to pinch the horse's jaw. Oversizing the hooks to alleviate this problem allows considerable slippage of the headstall straps and curb chain, which is contrary to the purpose of the hooks. Also, oversized hooks permit slippage of the curb chain and may lead to improperly fitted bits and a decrease in the leverage action provided by the curb chain. Some equestrian shows, such as quarter horse riding, allow the use of hook type bridle bits; the bit, however, must include a curb chain. Because the curb chain cannot be properly used without irritating the horse, some riders typically forego the use of the hook-type bit while competing in this type of show.

Further, whenever conventional hook-type bridle bits are used, the headstall straps (and/or reins) are often incorrectly attached to the hooks themselves. That is, instead of being looped around the cheek ring portion of the hook, the headstall straps are looped around the hooks. Such incorrect attachment of the headstall straps and/or reins causes misdirection of the force vectors from the reins to the mouthpiece so that a rider cannot properly control his horse.

For the foregoing reasons, there is a need for a new and improved bridle bit which overcomes the disadvantages of the prior art.

Accordingly, a bridle bit for horses is provided, which bridle bit includes headstall slots that do not cause irritation to the horse and are acceptable for use in most equestrian competitions. More particularly, a horse bridle bit is provided which comprises a mouthpiece to be received in the mouth of a horse. The bit further includes two cheek rings that are preferably substantially ring shaped. The cheek rings are connected to each end of the mouthpiece and reside immediately adjacent to the horse's cheeks when the bit is in use. Each cheek ring has a headstall slot extending radially through an upper circumferential portion of the ring so that each headstall slot is co-planar with a plane defined by the circumference of the ring. Each cheek ring may also include a rein slot extending radially through a lower circumferential portion of the ring so that each rein slot is co-planar with the plane defined by the circumference of the ring. Additionally, each cheek ring may include a curb chain aperture extending radially through the upper circumferential portion of each ring, disposed adjacent to a headstall slot so that each curb chain aperture is also co-planar with the plane defined by the circumference of the cheek ring.

The headstall slots and rein slots are designed to prevent slippage of the headstall and reins, respectively, around the circumference of the ring. Without slippage, the bridle bit 1 provides a rider with superior control of the horse. Because the slots are co-planar with the plane defined by the circumference of each ring, there are no lateral extensions protruding from the cheek rings that can pinch the horse. Consequently, the cheek rings lie flat against and parallel to the horse's cheek so as to avoid irritation of or injury to the horse.

The present bridle bit is easily and efficiently manufactured because each cheek ring is a single piece casting that includes a headstall slot and may include a rein slot and/or curb chain aperture. Accordingly, the presently provided bridle bit eliminates the need to weld headstall hooks to each cheek ring after the rings are cast (i.e., formed), thereby reducing manufacturing time and costs. Additionally, because the headstall slots and rein slots of the bridle bit are co-planar with the plane defined by circumference of the ring, the headstall slots cannot be seen when the bit is installed on a horse. Thus, the present bridle bit may be used in shows which prohibit the use of bridle bits that have hooks or lifters simply by looping the headstall and reins around the cheek rings rather than through the respective slots.

The curb chain aperture allows a curb chain to be coupled to the bit so that the curb chain fasteners that connect the chain to each cheek ring, do not pinch the horse's mouth. The bridle bit also prohibits curb chain slippage so that the leverage action of the curb chain is maximized. Accordingly, when a horse show requires the use of a curb chain, the present bridle bit may be used while avoiding pinching the horse or a decrease in the leverage action of the curb chain.

Additionally, when using the present bridle bit, headstall straps or reins cannot be incorrectly fastened to the bridle bit cheek rings. This is because the headstall strap slots are defined by the cheek rings and are coplanar with the plane defined by the circumference of the ring. Consequently, the present bridle bit consistently and accurately directs the pulling forces of the headstall straps and the reins regardless of whether the headstall straps or reins are looped around an inside wall that lies adjacent to the horse's cheek of a headstall slot or rein slot, respectively, or are looped around an outside wall of the respective slots.

These and other features, aspects, and advantages of the present invention are further described with reference to the following detailed description, claims, and accompanying drawings.

DETAILED DESCRIPTION OF THE INVENTION

Figure 2:
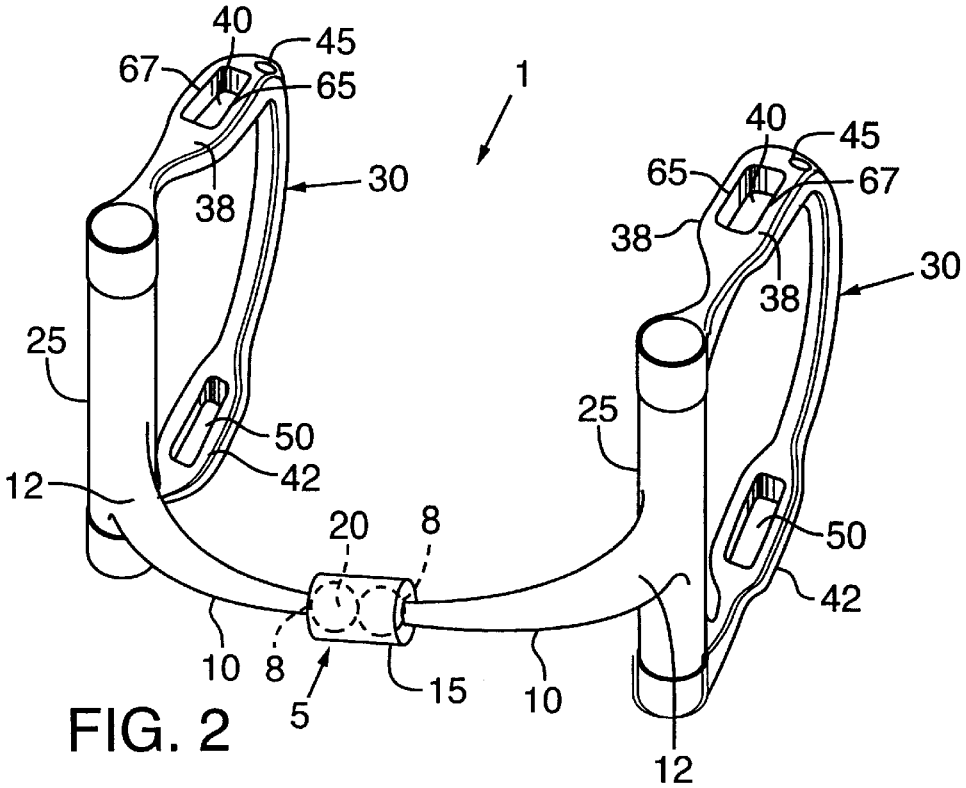
FIG. 2 is a perspective view of a bridle bit embodying features of the present invention.
Figure 5:
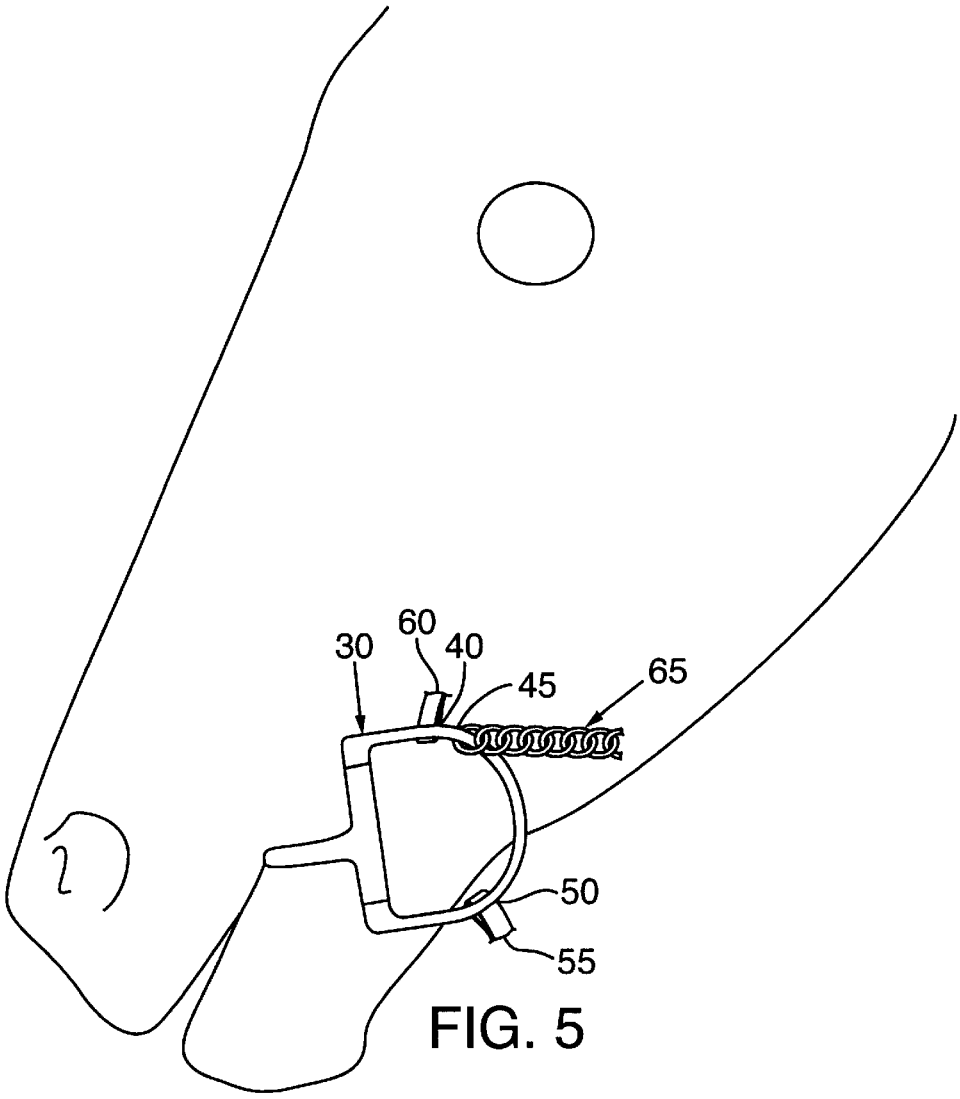
FIG. 5 is a side view of the bridle bit of FIG. 2 mounted on a horse's head.
Figure 7:
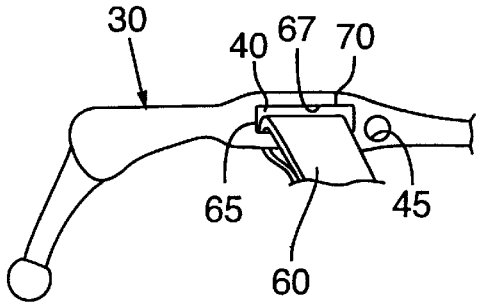
FIG. 7 is a partial top view of the bridle bit of FIG. 2 showing a headstall strap looped around an inside wall of a headstall slot.

Referring FIG. 2, a bridle bit 1 including a mouthpiece 5 and cheek rings 30 is provided. Each cheek ring 30 includes a headstall slot 40 through which a headstall straps 60 is connected (FIGS. 2, 5, and 7). The bridle bit 1 may further include rein slots 50 defined by each cheek ring 30 for receiving reins 50 (FIGS. 2 and 5). The bridle bit 1 may also include curb chain apertures 45 defined by each cheek ring 30 for receiving a curb chain 65 (FIGS. 2 and 5).

More particularly, bridle bit 1 includes a mouthpiece 5 sized and shaped to be received in a horse's mouth (FIGS. 2 and 5). The mouthpiece 5 of bridle bit 1 may comprise any known bridle bit mouthpiece, such as a unitary mouthpiece or a jointed snaffle having two or more interconnected members 10 forming an articulated joint (as shown in FIG. 2). Members 10 are preferably curved such that the mouthpiece 5 curves up to a horse's cheek when the bit 1 is inserted into the horse's mouth. When mouthpiece 5 comprises a jointed snaffle, the mouthpiece 10 preferably includes an inner end 8 that terminates in a ball or bearing 20. Bearings 20 of members 10 may be interconnected via a double ended ball and socket joint 15. Members 10 of the mouthpiece 5 may, alternatively, be jointed in a number of other ways. For example, inner ends 8 of members 10 may form interconnected eyes or loops.

Member 10 has an outer end 12 connected to a cheek ring 30. The outer end 12 of member 10 may form or connect to a longitudinally extending tubular journal member 25 adapted to receive the cheek ring 30. The outer end 12 of member 10 may, alternatively, be connected to the cheek ring 30 by other suitable connection means. For example, the outer end 12 of member 10 may terminate in a longitudinal bore (not shown) through which the cheek ring 30 is inserted so that the cheek ring 30 is slidable therein.

Figure 4:
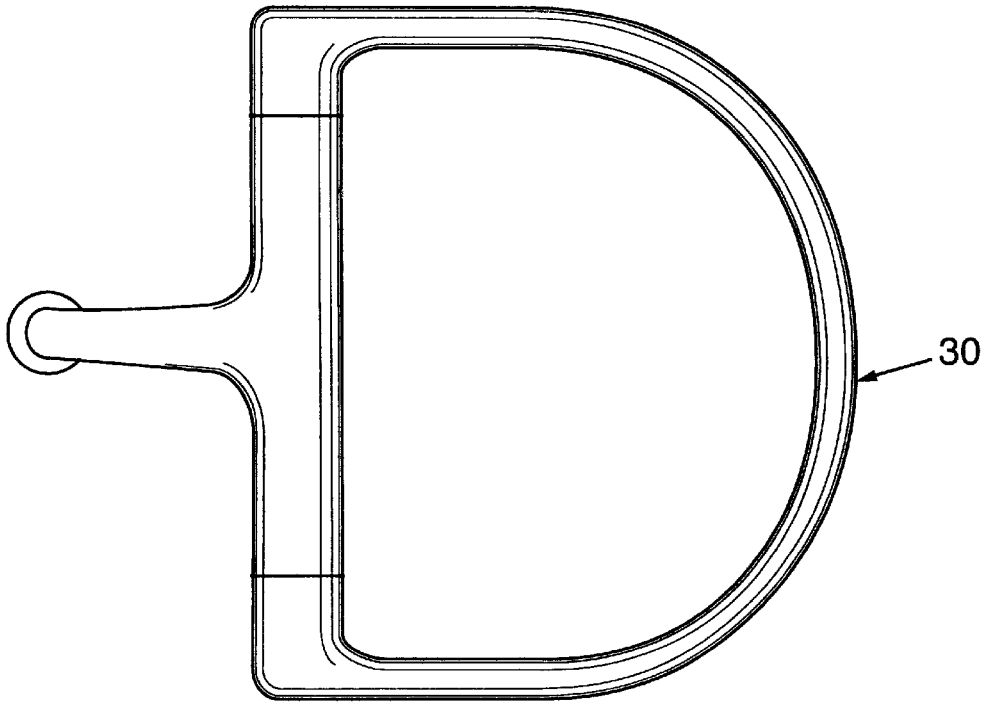
FIG. 4 is a side view of a cheek ring of the bridle bit of FIG. 2.

The cheek ring 30 may be any of a variety of shapes, such as circular or polygonal-shaped cheek rings. The cheek ring 30 is preferably D-shaped as shown in FIG. 4. A D-shaped cheek ring 30 preferably includes a straight portion comprising a shaft that is sized and shaped to be inserted into the journal member 25 of the mouthpiece 5. The cheek ring 30 straight portion is preferably rotatable relative to its longitudinal axis.

Figure 3:
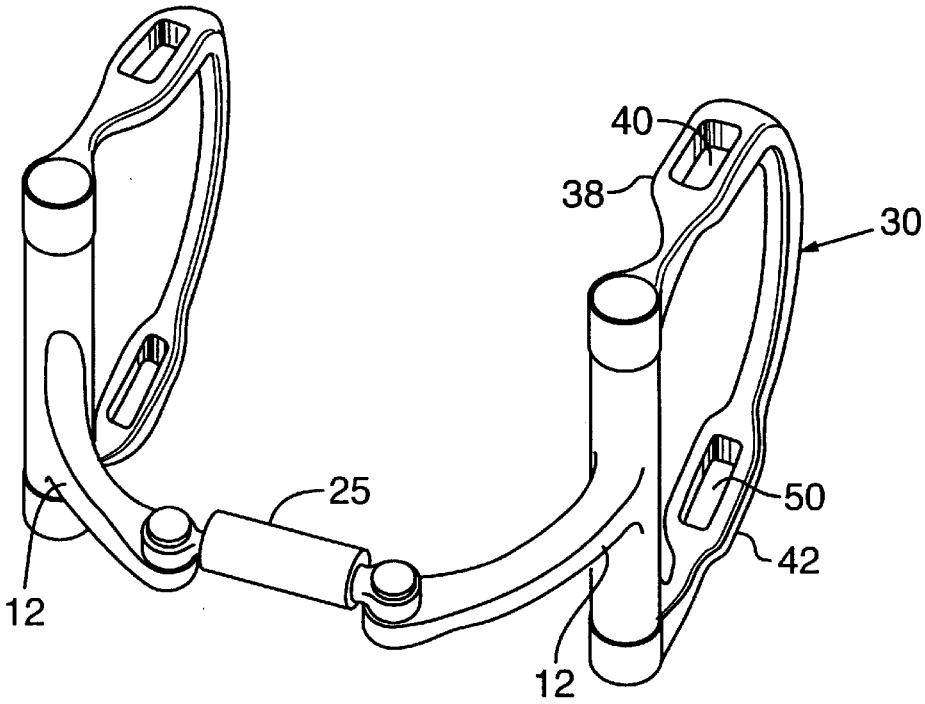
FIG. 3 is a perspective view of another bridle bit embodying features of the present invention.

Referring to FIG. 2, each cheek ring 30 further includes a headstall slot 40. The headstall slot 40 extends radially through an upper circumferential portion 38 of the cheek ring 30. Headstall slot 40 is co-planar with a plane defined by the circumference of the cheek ring 30. Accordingly, the cheek ring 30 is substantially parallel to the horse's cheeks when the bit 1 is mounted on the horse. The upper circumferential portion 38 of the cheek ring 30 defining the headstall slot 40 does not extend inwardly beyond the plane defined by the cheek ring 30 (see FIGS. 2, 3, and 7). Thus, no portion of the cheek ring 30 presses into a horse's cheek when the bridle bit 1 is installed in the horse's mouth and the headstall straps are connected. Further, the upper circumferential portion 38 of the cheek ring 30 defining the headstall slot 40 does not extend outwardly beyond the plane defined by the cheek ring 30. Accordingly, headstall slot 40 is not visible when the bridle bit 1 is installed on a horse. For example, as FIG. 4 illustrates, viewing the cheek ring 30 from the side does not reveal the headstall slot 40, so that the bridle bit 1 appears to be a conventional D-shaped bridle bit without a headstall slot or hook.

In order to optimize the accurate transfer of pulling forces from the reins to the mouthpiece, the centroid of each headstall slot 40 is preferably positioned along the circumference of each ring at approximately 50 to 80 degrees above an axis defined by each member 10.

Continuing to refer to FIG. 2, cheek ring 30 preferably further includes a rein slot 50. Rein slot 50 extends radially through a bottom circumferential portion 42 of each cheek ring 30. Each rein slot 50 is co-planar with the plane defined by the circumference of each cheek ring 30. Accordingly, as with the upper circumferential portion 38 of the cheek ring 30, the lower circumferential portion 42 defining the rein slot 50 does not extend beyond the plane defined by the cheek ring 30. The centroid of each rein slot 50 is preferably positioned along the circumference of each cheek ring 30 at approximately 50 to 80 degrees below the axis defined by member 10. As shown in FIG. 2, the inside walls of both the headstall slots 40 and rein slots 50 preferably form a slightly curved rectangle.

The dimensions of the headstall slots 40 may be about three quarters of an inch in length by about one quarter of an inch in width and about one quarter of an inch in depth. Similarly, the dimensions of the rein slots 50 may be about three quarters of an inch in length by about one quarter of an inch in width and about one quarter of an inch in depth. The size of the headstall slots 40 and rein slots 50 however, may be of any suitable dimensions that allow ready insertion of reins or straps while providing sufficient control over a horse by resisting relative movement of the headstall straps and reins.

The cheek ring 30 may also define a curb chain aperture 45. Curb chain aperture 45 extends radially through the upper circumferential portion 38 of each cheek ring 30 and is preferably disposed behind headstall slot 40. Curb chain aperture 45 is co-planar with the area defined by the circumference of the cheek ring 30.

It should be understood that the bridle bit 1 may incorporate only the headstall slots 40 without either the rein slots 50 or the curb chain apertures 45. Likewise, other embodiments of the bridle bit 1 may include only the headstall slots 40 and the rein slots 50, the headstall slots 40 and the curb chain apertures 45, or other various combinations of the bridle bit's novel and non-obvious features.

Referring to FIG. 5, bridle bit 1 is shown as installed on a horse's head. A rein 55 is looped through a rein slot 50 and a headstall strap 60 is looped through a headstall slot 40. The positioning and sizing of both the headstall slot 40 and rein slot 50 prevent slippage of the headstall strap 60 and/or the rein 55 about the circumference of the cheek ring 30, thereby providing a rider with superior control of the horse. Because the headstall slot 40 and rein slot 50 are co-planar with the plane defined by the circumference of the cheek ring 30, there are no lateral extensions protruding from the cheek rings 30 that pinch the horse's cheek when the rider pulls on the reins. Consequently, the cheek rings 30 lie substantially parallel to the horse's mouth so as to avoid irritation of or injury to the horse.

Figure 1:
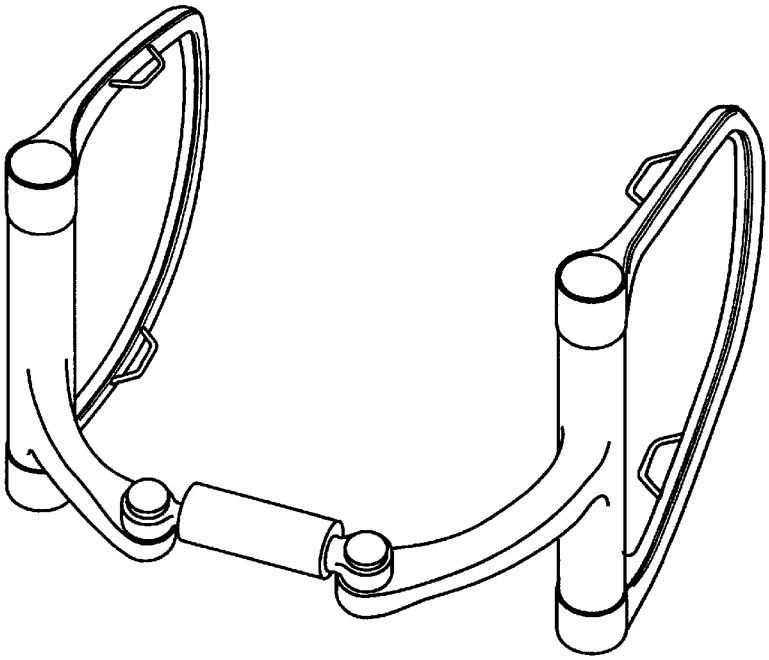
FIG. 1 (PRIOR ART)
FIG. 1 is a prior art bridle bit.

FIG. 7 shows a top view of bridle bit 1 wherein the headstall strap 60 is looped around inside wall 65 of the headstall slot 40. Unlike with conventional bridle bits (see, e.g., FIG. 1), reins and headstall straps cannot be incorrectly fastened to the cheek rings 30 of the bridle bit 1 because headstall slots 40 and/or rein slots 50 are co-planar with the plane defined by the circumference of the cheek rings 30. Consequently, the cheek rings 30 of the bridle bit 1 accurately direct the pulling forces of the headstall straps and reins to the mouthpiece 5 regardless of whether the headstall straps 60 are looped around the inside wall 65 of slot 40 (i.e., the side of slot 40 lying immediately adjacent the horse's cheek) or the outside wall 67 of the headstall slots 40 (see FIGS. 2 and 7).

Figure 6:
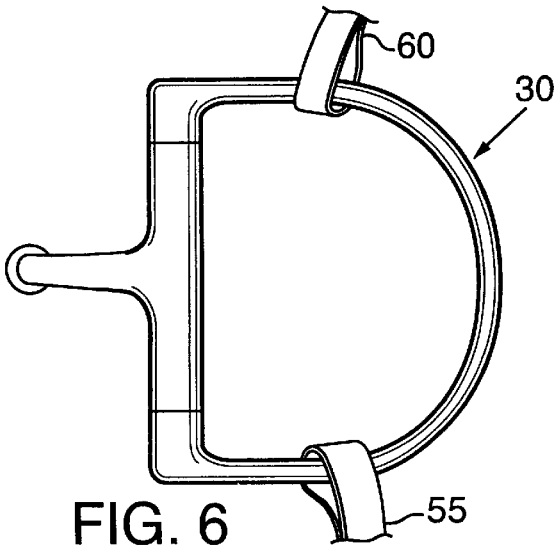
FIG. 6 is a side view of a bridle bit cheek ring with a headstall strap and a rein looped around the entire cross-sectional area of the cheek ring.

Alternatively, bridle bit 1 may be installed on a horse without use of the headstall slots 40, the rein slots 50, and/or the curb chain apertures 45. Thus, bridle bit 1 may be used in shows which prohibit the use of bridle bits having hooks or lifters. FIG. 6 illustrates a partial side view of the bridle bit 1 installed such that the headstall slots 40, the rein slots 50, and the curb chain apertures 45 are not in use. Accordingly, the rein 55 and headstall strap 60 are looped around the entire cross sectional area of the cheek ring 30 without being inserted through their respective slots. Because the slots are co-planar to the area defined by the circumference of the cheek ring 30, unlike headstall hooks of prior art bridle bits (see FIG. 1), the rein 55 and the headstall strap 60 are allowed to slide along the circumference of the ring 30 without restriction.

Having illustrated and described the principles of the invention with specific embodiments, it should be apparent to those skilled in the art that the invention can be modified in arrangement and detail without departing from such principles. We claim all modifications, alternatives, and equivalents as may come within the spirit and scope of the disclosed invention as defined by the appended claims.

What is claimed is:

1. A bridle bit comprising:

a mouthpiece adapted to be received in the mouth of a horse, the mouthpiece having laterally extending first and second ends;

a cheek ring connected to the first end of the mouthpiece, the cheek ring having an upper circumferential portion and a lower circumferential portion; and a headstall slot defined by the upper circumferential portion of the cheek ring and extending radially therethrough, the headstall slot being co-planar with a plane defined by a circumference of the cheek ring so that the headstall slot does not extend beyond the plane.

2. The bridle bit according to claim 1, further comprising an aperture sized and shaped to receive a curb chain, the aperture defined by the cheek ring and extending radially through the upper circumferential portion of the cheek ring, wherein the aperture is co-planar with a plane defined by a circumference of the cheek ring so that the aperture does not extend beyond the plane.

3. The bridle bit according to claim 1, wherein the cheek ring is D-shaped.

4. A bridle bit comprising:

a mouthpiece adapted to be received in the mouth of a horse, the mouthpiece having laterally extending first and second ends;

a cheek ring connected to the first end of the mouthpiece, the cheek ring being generally ring shaped and having an upper circumferential portion and a lower circumferential portion;

an aperture sized and shaped to receive a curb chain, the aperture defined by the cheek ring and extending radially through the upper circumferential portion of the cheek ring, wherein the aperture is co-planar with a plane defined by a circumference of the cheek ring so that the aperture does not extend beyond the plane; and a rein slot defined formed within the cheek ring, the rein slot extending radially through the lower circumferential portion, the rein slot being co-planar with a plane defined by a circumference of the cheek ring so that the rein slot does not extend beyond the plane.

5. A bridle bit comprising:

a mouthpiece adapted to be received in the mouth of a horse, the mouthpiece having laterally extending first and second ends;

a cheek ring connected to the first end of the mouthpiece, the cheek ring having an upper circumferential portion and a lower circumferential portion;

a headstall slot defined by the upper circumferential portion of the each cheek ring and extending radially therethrough, the headstall slot being coplanar with a plane defined by a circumference of the cheek ring so that the headstall slot does not extend beyond the plane defined by the circumference of the cheek ring; and a rein slot defined by the lower circumferential portion of the cheek ring and extending radially therethrough, the rein slot being co-planar with the plane defined by the circumference of the cheek ring so that the rein slot does not extend beyond the plane defined by the circumference of the cheek ring.

6. The bridle bit according to claim 5, wherein the cheek ring is D-shaped.

7. The bridle bit according to claim 6, wherein the first end of the mouthpiece includes a longitudinally extending tubular journal member for receiving the cheek ring.

8. The bridle bit according to claim 7, wherein the D-shaped cheek ring includes a curved portion and a straight portion, the straight portion comprising a shaft shaped and sized to be insertable into the tubular journal member.

9. A bridle bit comprising:

a mouthpiece adapted to be received in the mouth of a horse, the mouthpiece having laterally extending first and second ends;

a cheek ring connected to the first end of the mouthpiece, the cheek ring having an upper circumferential portion and a lower circumferential portion; and an aperture sized to receive a curb chain, the aperture extending radially through the upper circumferential portion of the cheek ring, the aperture being co-planar with a plane defined by a circumference of the cheek ring so that the cheek ring lies parallel to a horse's cheeks when installed on a horse.

10. The bridle bit according to claim 9, wherein the cheek ring is generally ring shaped.

11. The bridle bit according to claim 9, wherein the cheek ring is D-shaped.

12. The bridle bit according to claim 9, further comprising a headstall slot defined by the upper circumferential portion of the cheek ring and extending radially therethrough, the headstall slot being co-planar with a plane defined by a circumference of the cheek ring so that the headstall slot does not extend beyond the plane.

13. The bridle bit according to claim 12, further comprising a rein slot defined formed within the cheek ring, the rein slot extending radially through the lower circumferential portion, the rein slot being co-planar with a plane defined by a circumference of the cheek ring so that the rein slot does not extend beyond the plane.

14. The bridle bit according to claim 13, wherein the cheek ring, headstall slot, rein slot, and curb chain aperture are formed in a single casting.

15. The bridle bit according to claim 12, wherein a centroid of the headstall slot is positioned along the circumference of the cheek ring at about 50° to about 80° above an axis defined by the mouthpiece.

16. The bridle bit according to claim 12, wherein the curb chain aperture is positioned immediately adjacent the headstall slot.

* * * * *